US006817419B2

(12) United States Patent
Reid

(10) Patent No.: US 6,817,419 B2
(45) Date of Patent: Nov. 16, 2004

(54) WELL PRODUCTION MANAGEMENT AND STORAGE SYSTEM CONTROLLER

(76) Inventor: John A. Reid, 62 Linvale Rd., Ringoes, NJ (US) 08551

( * ) Notice: Subject to any disclaimer, the term of this patent is extended or adjusted under 35 U.S.C. 154(b) by 29 days.

(21) Appl. No.: 10/284,225

(22) Filed: Oct. 30, 2002

(65) Prior Publication Data

US 2004/0084178 A1 May 6, 2004

(51) Int. Cl.[7] ..... E21B 43/00

(52) U.S. Cl. ..... 166/369; 166/53; 417/36

(58) Field of Search ..... 166/250.03, 250.07, 166/250.15, 369, 54, 64, 250.01; 702/12, 100; 417/36, 18, 43, 212

(56) References Cited

U.S. PATENT DOCUMENTS

| | | | | |
|---|---|---|---|---|
| 2,239,612 A | | 4/1941 | Lawlor | 210/26 |
| 3,102,799 A | | 9/1963 | Kiekhaefer | 55/227 |
| 4,133,759 A | | 1/1979 | Ikeda et al. | 210/104 |
| 4,180,374 A | | 12/1979 | Bristow | 417/12 |
| 4,244,385 A | * | 1/1981 | Hotine | 137/1 |
| 4,375,833 A | | 3/1983 | Meadows | 166/64 |
| 4,519,418 A | | 5/1985 | Fowler | 137/571 |
| 4,664,143 A | | 5/1987 | Thompson | 137/567 |
| 4,693,271 A | | 9/1987 | Hargrove et al. | 137/565 |
| 4,700,734 A | | 10/1987 | McCauley | 137/236.1 |
| 4,962,789 A | | 10/1990 | Benscoter | 137/571 |
| 5,035,581 A | * | 7/1991 | McGuire et al. | 417/36 |
| 5,129,415 A | | 7/1992 | Runyon et al. | 137/113 |
| 5,197,859 A | | 3/1993 | Siff | 417/19 |
| 5,577,890 A | | 11/1996 | Nielsen et al. | 417/44.2 |
| 5,941,305 A | * | 8/1999 | Thrasher et al. | 166/53 |
| 6,077,044 A | | 6/2000 | Reid | 417/2 |
| 6,615,925 B2 | * | 9/2003 | Rice | 166/369 |

* cited by examiner

*Primary Examiner*—David Bagnell
*Assistant Examiner*—K. Thompson
(74) *Attorney, Agent, or Firm*—Kenneth P. Glynn, Esq.

(57) ABSTRACT

In a well production management and storage system having at least one collecting tank and the well pump and a control panel with a timing trigger for activating the well pump and deactivating the well pump for a first predetermined run cycle and a first predetermined rest cycle, the improvement is a controller for adjusting at least one of the first predetermined run cycle and the predetermined rest cycle. This controller detects either changes in rate of rise in liquid in the collecting tank and/or water level in the well when the pump is in a run cycle. When these parameters change, by a predetermined increment, the pump run cycle and/or rest cycle is automatically adjusted.

17 Claims, 2 Drawing Sheets

WELL PRODUCTION MANAGEMENT AND STORAGE SYSTEM CONTROLLER

BACKGROUND OF THE INVENTION

1. Field of the Invention

The present invention relates to well production management and storage system controllers, and more particularly to well management system controllers for systems that include at least one underground well, one separate collecting tank for use with a pump and an electrically powered control panel capable of managing and maintaining a reasonably constant supply of water in the collecting tank. The controller is, in one preferred embodiment, based on changes in the rate of rise of liquid in the tank. In other embodiments, the controller operates on the basis of the foregoing and/or pump shut down during run cycle, and/or well water level during run cycle. In response to such changes, the run cycle and/or rest cycle of the pump is adjusted.

2. Information Disclosure Statement

The following patents describe the state of the art in well pumping systems.

U.S. Pat. No. 2,239,612 to Joseph P. Lawlor describes a raw water storage tank in an iron removal system having a water space, a compressed air space above the water level in the tank, means for admitting water and air into the tank, a repression tank having a water space and also having a compressed air space above the water level in that tank, a water service line connected to the water space of the repression tank and having a back check valve, a filter, a pipe for conveying water from the water space of the raw water tank into the top of the filter, a pipe for conveying water from the water space of the raw water tank into the top of the filter, a pipe for conveying the filtered water from the filter into the water space of the repression tank, a back-wash line connected to the pipe which conveys the water from the raw water tank to the filter and having a shut-off valve, there being another shut-off valve in the pipe between the raw water tank and the place of connection therewith of the back-wash line, an air pressure equalizing line connecting the air space of the raw water tank with the air space of the repression tank, and a shut-off valve in the air pressure equalizing line.

U.S. Pat. No. 3,102,799 to Elmer Carl Kiekhaefer describes a water supply system for a residence with a water wheel, comprising, in combination, a narrow stand-pipe disposed adjacent the well and having an open top substantially higher than the roof of the residence, pump means connecting the well with the lower end of the stand-pipe for introduction of water into the latter, pressure-controlled switch means connecting the stand-pipe with the pump means so that the latter will be operated to maintain water in the stand-pipe between two desired levels closely adjacent to the top, a conduit disposed closely adjacent to the lower of the two levels and extending within the residence to supply water thereto, means to supply a cleansing gas to the bottom of the stand-pipe so that the gas will bubble up through the water and remove odors therefrom, a dome-shaped cap secured to the open top of the stand-pipe and having an annular filter disposed around the pipe so that gas escaping from the water will be discharged above the roof of the residence and impurities cannot be admitted to the water, the pump means including a conduit which discharges water into said stand-pipe at a point above the gas supplying means and upwardly to produce turbulence in the water so that any gas bubbles clinging to the wall of the stand-pipe will be released, means to operate the gas supplying means simultaneously with the pump means, and means to provide a timed continuation of operation of the gas supplying means after said pump means has ceased operating.

U.S. Pat. No. 4,133,759 Yorifumi Ikeda et al describes a liquid purification apparatus which comprises a hollow cylindrical column having a liquid rectifier and collector positioned respectively adjacent the bottom and top of the column in communication with liquid inlet and outlet. A mass of adsorbent material is accommodated within the column in such an amount that a portion of the material within the column and above the liquid collector forms a settling layer to avoid any possible fluidization and/or expansion of another portion of the material situated between the liquid rectifier and collector. The column has a material inlet at the top thereof through which material is continuously supplied into the column while a portion of the material adjacent the bottom of the column is exhausted to the outside through an outlet at the bottom of the column. The uppermost surface level of the material within the column is maintained within a predetermined range.

U.S. Pat. No. 4,180,374 to Elliott R. Bristow describes a protection system for a well pump in which a normal pressure switch is provided in series between this switch and the submerged motor and pump with a low pressure switch which has connected in parallel thereto a timing device which can in turn transmit directions to the pump, motor, control and starter to assure that a pump is not allowed to continue to run when there is no water in the well thereby causing a burnout. Check valves and a bleeder line are carefully positioned in this series to assure that the reading given by the low pressure switch, the normal pressure switch are real readings and that the pump is not inadvertently allowed to run due to incorrect signals derived therefrom.

U.S. Pat. No. 4,375,833 to Floyd G. Meadows describes a system for chemical treatment of producing oil wells has automatically actuated valves operated by a control circuit. The control circuit causes the system to automatically switch the well from production to treatment status without shutting down. After a predetermined treatment period, wherein well fluids mixed with treatment chemical are recirculated throughout the well, the control circuit causes the system to change state and switch to production status. One embodiment of a means for pumping the treatment chemical into the well includes a continuous pump actuated by the mechanism of the well pump, and which includes two electrically actuated valves. The control circuit automatically operates the valves to cause treatment chemical to be injected into the well when desired, then changes the position of the valves so that the chemical which is continuously being pumped will return to the storage tank in a continuous stream.

U.S. Pat. No. 4,519,418 to L. B. Fowler describes a water well pumping system for controlling the volume of fluid supplied to a supply reservoir from a primary reservoir and drawn off through an outlet conduit to the volume of fluid produced and pumped from the well. A fixed or variable resistance is interposed in piping between the primary and supply reservoir.

U.S. Pat. No. 4,664,143 to Ernest N. Thompson describes a water supply recirculation system is provided having a recirculation pump and a duct into which the recirculation pump propels water. A selectively operated, closed at rest, flow valve is maintained open while the pump operates. A flow sensor serially installed in the recirculation duct detects flow and senses a failed condition. A second control valve which rests in an open position selectively prevents passage of water from the recirculation duct into a drain duct when pumping is in progress. The recirculation duct transmits water into a water supply tank and discharges it onto the central surface of the water supply in the tank. When pumping ceases, the first control valve closes, and the second control valve opens, allowing water in the duct to drain from the duct.

U.S. Pat. No. 4,693,271 to Benjamin F. Hargrove et al describes a horizontally mounted submersible pump assembly for pumping water from water storage tanks, which pump assembly is characterized by a submersible pump mounted inside a horizontally orientated tube extending through the wall of the water storage tank. A valve is provided in cooperation with the immersed end of the tube to facilitate flow of water into the tube to the pump and the opposite, dry end of the tube is closed by an adapter flange mounted on a length of adapter pipe, one end of which extends into the tube and communicates with the discharge of the pump and the other end of which is flanged to a water distribution line. The water distribution line extends to a conventional pressure tank for distributing water to multiple users on demand. The submersible pump is typically of turbine design and is sized to quickly and effectively pressurize the water distribution system by pumping the water from the storage tank and the flooded tube to the pressure tank. The tube enclosing the pump facilities removal and replacement of the pump from the dry end of the tube without draining the storage tank.

U.S. Pat. No. 4,700,734 to Robert G. McCauley relates to water collecting and spring box and gauging system and water holding tank wherein the spring box is designed to receive and collect water from a source such as a spring. Once collected in the spring box, the water is filtered prior to being directed to a water holding tank that is normally stationed near a point between the spring and location of ultimate use. The spring box includes a water inlet, a drain, and a supply outlet. The flow rate of water from the spring box is controlled by varying the height of the water level maintained in the spring box and by selectively sizing and spacing openings formed in a vertical water filter that is communicatively connected to the supply outlet.

U.S. Pat. No. 4,962,789 to Kenneth Benscoter describes an emergency fresh water reservoir provided for a building for use in emergencies, such as earthquakes, floods, hurricanes and other natural disasters in which municipal water supplies are cut off or rendered impure or unpotable. The emergency water reservoir of the invention can also be used to provide a supply of water in times of man made disasters, such as war or acts of terrorism or vandalism which can render municipal water supplies suspect or unusable. The emergency water reservoir is connected between a municipal water supply line and a hot water heater for a building. Water passes through the emergency water reservoir before reaching the hot water heater. circulation of fresh water is assured and stagnancy of water is prevented during normal operation of municipal water supply due to a flow through the emergency water reservoir to replenish water in the hot water heater, as hot water is utilized in the building. In times of emergency water can be drawn directly from the emergency water supply.

U.S. Pat. No. 5,129,415 to Robert R. Runyon et al describes a system and method for selecting one of a plurality of liquid supply receptacles as a source of supply for a liquid dispensing apparatus is disclosed. As liquid is withdrawn from the supply receptacle the dielectric constant of the liquid is sensed in order to detect any undissolved gases (i.e., bubbles) which are present in the liquid. The presence of bubbles within the liquid indicates that a supply receptacle has become empty or indicates a failure of components associated with one of the supply receptacles. Upon the detection of undissolved gases within the liquid withdrawn from a supply receptacle, the present invention causes another liquid supply receptacle to be selected as a source of supply for the liquid dispensing apparatus. Embodiments of the present invention desirably also include switches for manually inputting when a liquid supply receptacle has been refilled or replaced, indicators for visually showing the status of the system, and a remote annunciator for communicating the status of the system to a point remote from the liquid supply receptacles.

U.S. Pat. No. 5,197,859 to Elliot J. Siff describes a well pump system having a motor-driven pump and a pressure tank for delivering water from a source to a utilization point. A sensing device detects a parameter correlated to the rate of flow into and out of the pressure tank. The parameter is utilized to regulate flow into the tank so as to establish at least approximate equality between flow into and out of the tank.

U.S. Pat. No. 5,577,890 to Carl J. Nielsen et al describes a pump control and protection system comprised of an analog module and a digital module. The analog module includes a synchronous phase detector, a pressure transducer and an over voltage/under voltage circuit. The synchronous phase detector determines the phase angle between a current signal supplied to a water pump and a voltage signal supplied to the pump. The output of the phase detector is directed to a programmable array logic device in the digital module and used to activate a solid state relay that controls the power supplied to the pump. The water pressure in the system is displayed on a digital display.

U.S. Pat. No. 6,077,044 to John A. Reid describes a well pump storage and delivery assembly includes at least one collecting tank coupled to at least one source of water being derived from an underground well having a well pump therein. The collecting tank has an upper water level measuring member capable of detecting and measuring an upper level of water collected within the collecting tank and a lower water level measuring member capable of detecting and measuring a lower level of water collected within the collecting tank. A pressurization pump is connected to the collecting tank and is capable of receiving water therefrom. The pressurization pump is connected to a pressurized storage tank. A control panel is included and has a timer trigger for activating the well pump, a delay mechanism for governing the activation and de-activation of the well pump by a pre-selected time period, a regulating member for activating and deactivating the well pump incident to the detection of water in the well and a member for regulating the activation and de-activation of the pressurization pump.

Notwithstanding the above prior art, it is believed that the well production management and storage system, as set forth herein, is neither taught nor rendered obvious.

SUMMARY OF THE INVENTION

The present invention system controller is for well production management and storage. A basic well system includes a well with at least one well pump, often a submersible well pump, at least one collecting tank and a control panel with a timing trigger for turning the well pump on and off based on a set timing sequence. It has been recognized, however, that well yields change over time. These changes may occur in short periods of time or long periods of time, may be permanent or cyclical and may be erratic or somewhat predictable. An individual well may experience yield changes due to natural phenomenon, such as earthquakes, draughts, excessive spring thaw, individual storms, or long-term weather pattern changes. Unnatural changes may result from increase population, inadequate restoration of consumed water to the aquifer and other environmental issues, as well as short-term pattern changes, such as water usage between seven a.m. and eight a.m. on weekdays when everyone is showering or bathing around the same time.

Many of the aforesaid fluctuations may not affect a preset run cycle and/or rest cycle of a well pump until a user runs out of water or experiences very low pressure. In many cases, the timer of the control panel must be reset to work with the changed well yields. Unfortunately, this approach is often too little too late because the user is inconvenienced at best and the well system is stressed before correction occurs.

The present invention is directed to recognizing one or more indicators of ensuing problems when well yield changes, and making corrections to the system before any user inconvenience or system damage occurs.

Thus, the present invention relates to a well production management and storage system having at least one collecting tank and at least one well pump and a control panel with a timing trigger for activating the well pump and deactivating the well pump for a first predetermined run cycle and a first predetermined rest cycle. The present invention is a system controller for recognizing either a change in rate of rise in well collecting tank during operation of the pump, a change in well water level, at any measured time, or both, and making adjustments to the well pump run cycle and/or rest cycle.

In one preferred embodiment, the present invention controller for adjusting at least one of the first predetermined run cycle and the predetermined rest cycle includes (a) detecting means for detecting change in rate of rise in liquid in the collecting tank when the at least one pump is in a run cycle;

(b) upward adjustment means for increasing the first run cycle or decreasing the first rest cycle, or both, by a predetermined increment, in response to a detection of increase in the rate of rise of liquid in the collecting tank that exceeds a preset rate of rise increase increment; and, (c) downward adjustment means for decreasing the first run cycle or increasing the first rest cycle, or both, by a predetermined increment, in response to a detection of decrease in the rate of rise of liquid in the collecting tank that exceeds a preset rate of rise decrease increment.

The system controller of the present may optionally include limiting means to prevent further increase adjustment beyond a preset limit.

In some embodiments, the rate of rise detecting means may include a level gauge, a clock, and a comparator.

In other embodiments, it may include a pressure sensor, a clock, and a comparator.

In some preferred embodiments, the present invention controller includes a computer device with sufficient hardware and software affiliated therewith so as to:

(i) read and store liquid levels of the collecting tank at specified times during well pump run cycles;

(ii) calculate rates of rise in the collecting tank during run cycles by calculating differences in the liquid levels for specified periods of times;

(iii) associate the calculated rates of rise with a chronological designation, such as date and time, sequential numbering, or the like, and store the rates of rise with their associated chronological designation;

(iv) compare a new calculated rate of rise with an earlier stored rate of rise, e.g. a starting rate of rise obtained during the first run cycle, to determine if a change had occurred in excess of a specified incremental difference; and, (v) if a change has not occurred in excess of a specified increment difference, maintain status quo. If a change has occurred in excess of a specified incremental difference, and if the change is an increase, the computer will increase the run cycle or decrease the rest cycle, or both, by a predetermined amount, and if a change has occurred in excess of a specified incremental difference, and if the change is a decrease, the computer will decrease the run cycle or increase the rest cycle, or both, by a predetermined amount. In preferred embodiments, the computer device operates on the basis of utilizing the first run cycle and the first rest cycle as a baseline for changes, and uses the first run cycle to obtain the aforementioned earlier stored rate of rise as a benchmark for all comparisons of subsequent rates of rise. In other preferred embodiments, the benchmark may be based on quarterly readings, manual resets, averages, or some other criteria set by the equipment and/or user.

In preferred embodiments, the computer device also includes means for setting the first run cycle and the first rest cycle before the pump is first turned on. Most preferred is when the upward adjustment means and the downward adjustment means is a single means with sufficient software and hardware to accommodate both upward adjustments and downward adjustments.

In some preferred embodiments, the computer device includes sufficient software and hardware associated therewith to enable a user to input a specific tank size and a specific well yield rate, and to then calculate for the user and display a first run cycle and a first rest cycle. This may include a manual override feature.

In other embodiments of the present invention, the controller includes (a) detecting means for detecting change in water level in the well;

(b) upward adjustment means for increasing the run cycle or decreasing the rest cycle, or both, by a predetermined increment, in response to a detection of increase in the well water level that exceeds a preset water level increase increment; and, (c) downward adjustment means for decreasing the run cycle or increasing the rest cycle, or both, by a predetermined increment, in response to a detection of decrease in the well water level that exceeds a preset water level decrease increment.

In some preferred embodiments, the aforesaid controller includes a computer device with sufficient hardware and software affiliated therewith so as to:

(i) read and store water level in the well at specified times;

(ii) associate each read well water level with a chronological designation and store the water levels with their associated chronological designations;

(iii) compare a new well water level with an earlier stored water level to determine if a change had occurred in excess of a specified incremental difference; and, (iv) if a change has not occurred in excess of a specified increment difference, maintain status quo, and if a change has occurred in excess of a specified incremental difference, and if the change is an increase, increase the run cycle or decrease the rest cycle, or both, by a predetermined amount, and if a change has occurred in excess of a specified incremental difference, and if the change is a decrease, decrease the run cycle or increase the rest cycle, or both, by a predetermined amount.

The water level in a well may be read or obtained by many known means, and the basis may be any preset basis. In other words, the water level may be measured from the ground level, the pump location or any other basis. Further, the water level may be measured by sensors at various elevations, by a float, electronically, via pressure sensor, etc.

In other preferred embodiments of the present invention, the controller for adjusting at least one of the first predetermined run cycle and said predetermined rest cycle includes:

(a) automatic shut off means to shut down the well pump when the well has a water level that falls below the pump during a run cycle;

(b) detecting means for detecting shut down of well pump when it is in a run cycle;

(c) downward adjustment means for decreasing the first run cycle or increasing the first rest cycle, or both, by a predetermined increment, in response to a detection of the shut down of said at least one well pump.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
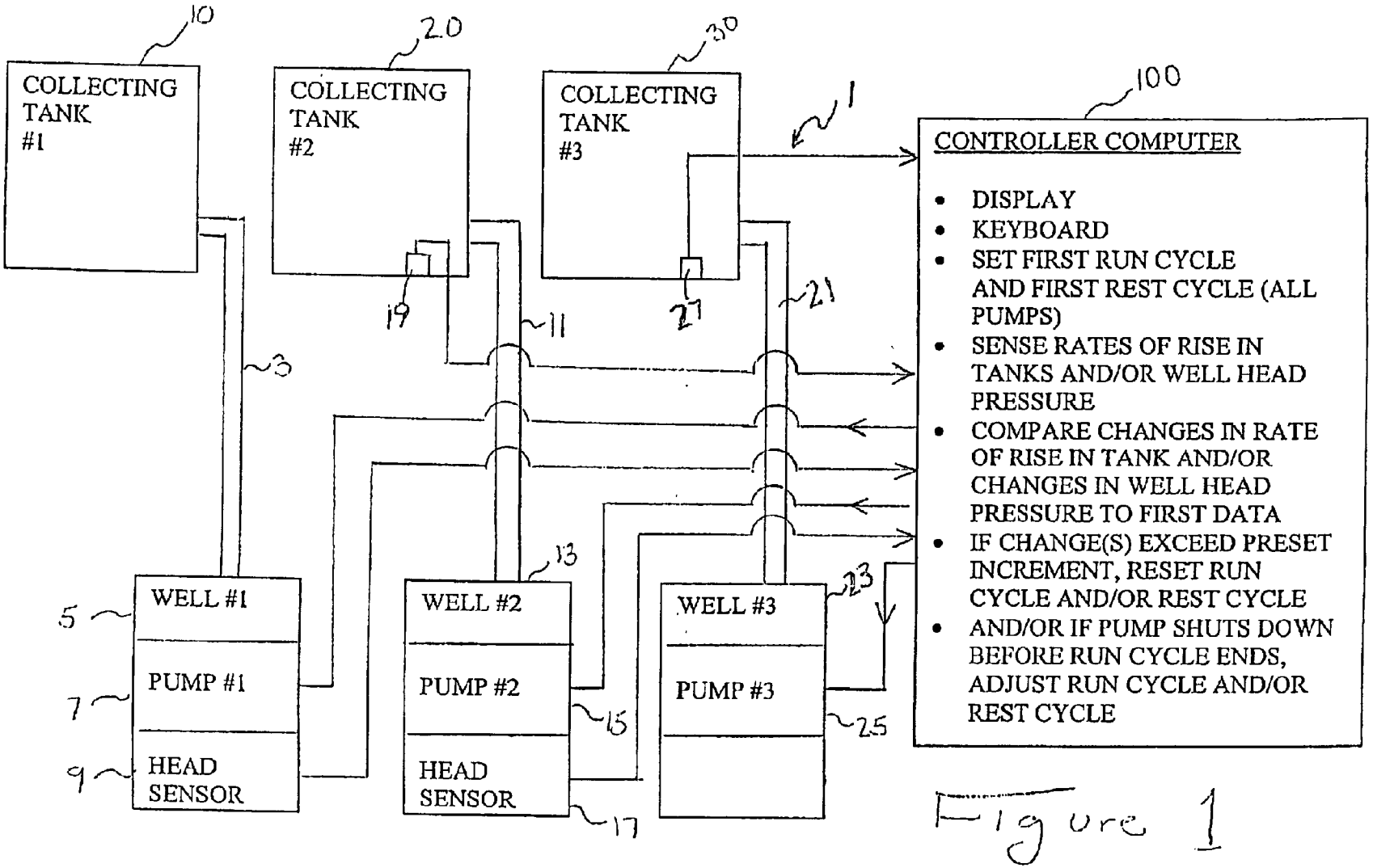
FIG. 1 shows a schematic diagram of the present invention involving a multiple well system utilizing different types of controls.

FIG. 1 shows a present invention system 1 that includes multiple wells, multiple collecting tanks, multiple pumps and a single controller that operates in accordance with different alternatives of the present invention. Collecting tanks 10, 20 and 30 are respectively connected to wells 5, 13 and 23 via well shafts and standard plumbing 3, 11 and 21 respectively. Well 5 includes a pump 7 and a pressure sensor 9 that measures head of pressure in the well and may, for example, be a transducer. Sensor 9 provides well head pressure feedback to controller computer 100 when pump 7 is operating. Well 13 has a pump 15 and a sensor 17, similar to sensor 9 in well 5. Well 23 includes a pump 25 but has no sensor contained therein. Collecting tank 10 is a standard collecting tank, but collecting tanks 20 and 30 contain rate of rise detectors 19 and 27, as shown. These would measure pressure or height at specific points in time during pump operations to generate rate of rise data.

An operator would operate the present invention system 1 by programming various components through computerized control at controller computer 100. The first run cycle and the first rest cycle for the three well pumps would be set by the operator. These settings would be based on practical information within the knowledge of the operator, such as well production (yields based on prior testing or usage), tank size (diameter or cross section), pump rating, and perhaps experience for the region.

The sensors 19 and 27 would measure either height changes of the tank water level, or some parameter by which this could be determined by the computer (e.g., pressure change, light sensor, inflow less outflow over time). The controller computer 100 would take these readings at specified time intervals, e.g., at the thirty second and one minute points of pump run time, determine the rate of rise in the tank and store it chronologically, e.g., by date and time. When the rate of change would exceed the base or first rate of change reading (taken during the first run cycle) by a predetermined increment or threshold, then the pump run and/or rest cycles would be adjusted. For example, the pump 15 might have a first run cycle of six minutes with a rest cycle of 35 minutes. The starting rate of rise in tank 20 might be 8 inches per minute. If the preset increment for action is set at a change of ½ inch per minute, then for each full ½ inch per minute increase in rate of rise in the tank during subsequent run cycles, the computer would reset the run cycle to increase by two minutes, or decrease the rest cycle by five minutes or some combination of both. Similarly, if sensors 9 or 17 showed a change in the well water level, e.g. as measured by head pressure, in excess of a preset increment or threshold, then the pump corresponding to it would have its run cycle and/or rest cycle adjusted by a preset increment to compensate. Tank 10 and its well 5 rely only on well head pressure sensing, tank 20 and well 13 rely upon both rate of rise changes and well head pressure changes, and tank 30 and its well 23 rely on rate of rise changes without well head sensors. Optionally, these well may also include a system feature wherein if a pump shuts down before the end of a run cycle, because the well water level is too low, then the controller computer 100 will reduce the run cycle and/or extend the rest cycle by preset increments until the well does not run dry before the run cycle ends.

Figure 2:
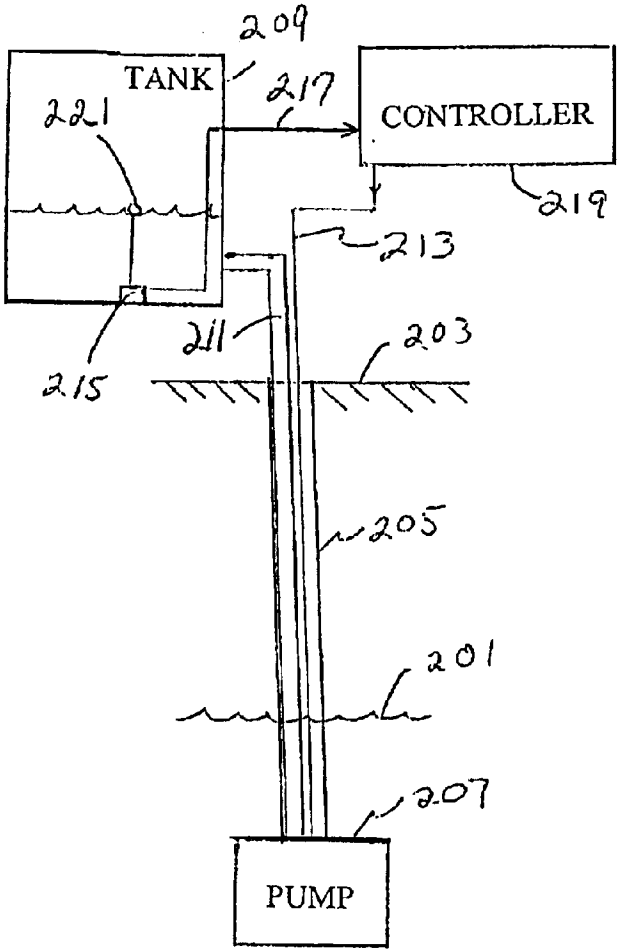
FIG. 2 illustrates a single well present invention embodiment utilizing rate of rise changes as the pump control parameter; and, FIG. 3 illustrates a single well present invention embodiment utilizing well water level as the pump control parameter.

FIG. 2 shows a single tank 209 with a present invention controller 219. There is a well shaft 205 with well water level 201 below ground 203. Tank 209 includes a float 221 and a liquid level sensor 215 responsive to float 221. Sensor 215 provides feedback to controller 219 via connection 217. Water is pumped into tank 209 through pipe 211 by pump 207 for a fixed period of time (run cycle) and is then shut off for a predetermined period of time (rest cycle). This is repeated until a rate of rise is measured when pump 207 is running, that is determined by controller 219 to exceed a predetermined threshold or increment. When this occurs, controller 219 via connection 213 will make an appropriate adjustment to either the pump run cycle or the pump rest cycle, or both.

Figure 3:
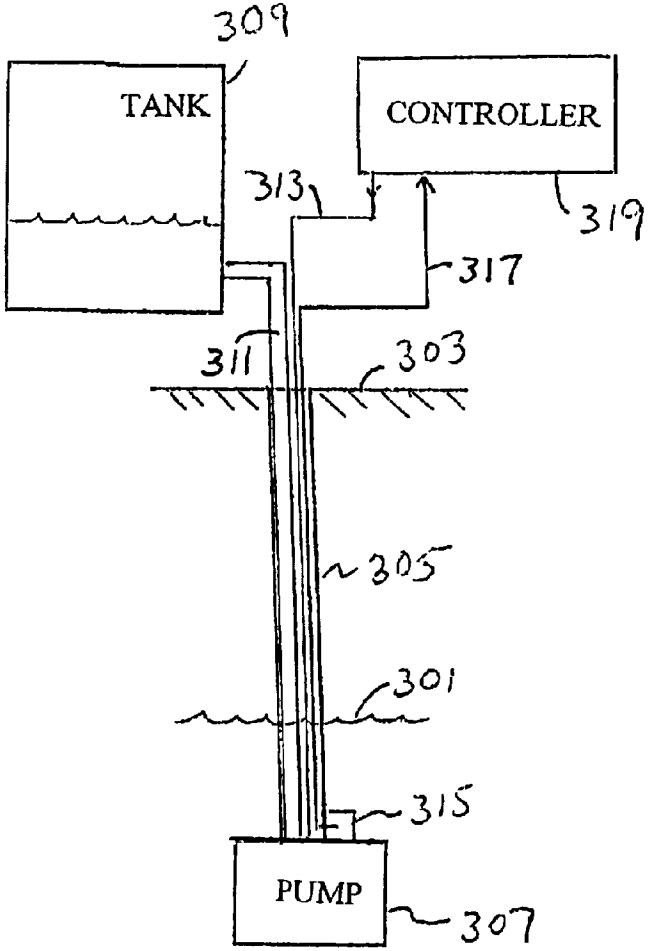

FIG. 3 shows a single tank 309 with a present invention controller 319. There is a well shaft 305 with well water level 301 below ground 303. Tank 309 does not include any sensors as in FIG. 2 above. Instead, water level sensor 315 provides feedback to controller 319 via connection 317. Water is pumped into tank 309 through pipe 311 by pump 307 for its run cycle, and is then shut off for a predetermined period of time, its rest cycle. This is repeated until well water level measured and sensed by sensor 315 and controller 319 to exceed a predetermined threshold or increment. When this occurs, controller 319 via connection 313 will make an appropriate adjustment to either the pump run cycle or the pump rest cycle, or both.

Obviously, numerous modifications and variations of the present invention are possible in light of the above teachings. It is therefore understood that within the scope of the appended claims, the invention may be practiced otherwise than as specifically described herein.

What is claimed is:

1. In a well production management and storage system having at least one collecting tank and at least one well pump and a control panel with a timing trigger for activating said at least one well pump and deactivating said one well pump for a first predetermined run cycle and a first predetermined rest cycle, the improvement, which comprises:

a controller for adjusting at least one of said first predetermined run cycle and said predetermined rest cycle, said controller including:

(a) detecting means for detecting change in rate of rise in liquid in said collecting tank when said at least one pump is in a run cycle;

(b) upward adjustment means for increasing said first run cycle or decreasing said first rest cycle, or both, by a predetermined increment, in response to a detection of increase in said rate of rise of liquid in said collecting tank that exceeds a preset rate of rise increase increment;

(c) downward adjustment means for decreasing said first run cycle or increasing said first rest cycle, or both, by a predetermined increment, in response to a detection of decrease in said rate of rise of liquid in said collecting tank that exceeds a preset rate of rise decrease increment; and, (d) a computer device with sufficient hardware and software affiliated therewith so as to:

(i) read and store liquid levels of said at least on collecting tank at specified times during well pump run cycles;

(ii) calculate rates of rise in said at least one collecting tank during run cycles by calculating differences in said liquid levels for specified periods of times;

(iii) associate said rates of rise with a chronological designation and store said rates of rise with their associated chronological designation;

(iv) compare a new calculated rate of rise with an earlier stored rate of rise to determine if a change had occurred in excess of a specified incremental difference; and, (v) if a change has not occurred in excess of a specified increment difference, maintain status quo, and if a change has occurred in excess of a specified incremental difference, and if the change is an increase, increase said run cycle or decrease said rest cycle, or both, by a predetermined amount, and if a change has occurred in excess of a specified incremental difference, and if the change is a decrease, decrease said run cycle or increase said rest cycle, or both, by a predetermined amount.

2. The system of claim 1 wherein said controller also includes:

(d) limiting means to prevent further increase adjustment beyond a preset limit.

3. The system of claim 1 wherein said detecting means includes a level gauge, a clock, and a comparator.

4. The system of claim 1 wherein said detecting means includes a pressure sensor, a clock, and a comparator.

5. The system of claim 1 wherein said computer device operates on the basis of utilizing said first run cycle and said first rest cycle to obtain said earlier stored rate of rise as a benchmark for all comparisons of step (iv).

6. The system of claim 1 wherein said computer device includes means for setting said first run cycle and said first rest cycle.

7. The system of claim 1 wherein said upward adjustment means and said downward adjustment means is a single means with sufficient hardware to accommodate both upward adjustments and downward adjustments.

8. The system of claim 1 wherein said computer device includes sufficient software and hardware associated therewith to enable a user to input a specific tank size and a specific well yield rate, and to then calculate and display a first run cycle and a first rest cycle.

9. In a well production management and storage system having at least one collecting tank, at least one well pump, at least one well, and a control panel with a timing trigger for activating said at least on well pump and deactivating said one well pump for a first predetermined run cycle and a first predetermined rest cycle, the improvement, which comprises:

a controller for adjusting at least one of said first predetermined run cycle and said predetermined rest cycle, said controller including:

(a) detecting means for detecting change in water level in said at least one well;

(b) upward adjustment means for increasing said first run cycle or decreasing said first rest cycle, or both, by a predetermined increment, in response to a detection of increase in said water level that exceeds a preset well water level increase increment;

(c) downward adjustment means for decreasing said first run cycle or increasing said first rest cycle, or both, by a predetermined increment, in response to a detection of decrease in said water level that exceeds a preset well water level decrease increment; and, (d) a computer device with sufficient hardware and software affiliated therewith so as to:

(i) read and store liquid levels of said at least on collecting tank at specified times during well pump run cycles;

(ii) calculate rates of rise in said at least one collecting tank during run cycles by calculating differences in said liquid levels for specified periods of times;

(iii) associate said rates of rise with a chronological designation and store said rates of rise with their associated chronological designation;

(iv) compare a new calculated rate of rise with an earlier stored rate of rise to determine if a change had occurred in excess of a specified incremental difference; and, (w) if a change has not occurred in excess of a specified increment difference, maintain status quo, and if a change has occurred in excess of a specified incremental difference, and if the change is an increase, increase said run cycle or decrease said rest cycle, or both, by a predetermined amount, and if a change has occurred in excess of a specified incremental difference, and if the change is a decrease, decrease said run cycle or increase said rest cycle, or both, by a predetermined amount.

10. The system of claim 9 wherein said detecting means includes a level gauge, a clock, and a comparator.

11. The system of claim 9 wherein said computer device operates on the basis of utilizing said first run cycle and said first rest cycle to obtain said earlier stored water level as a benchmark for all comparisons of step (iii).

12. The system of claim 9 wherein said computer device includes means for setting said first run cycle and said first rest cycle.

13. The system of claim 9 wherein said upward adjustment means and said downward adjustment means is a single means with sufficient hardware to accommodate both upward adjustments and downward adjustments.

14. In a well production management and storage system having at least one collecting tank, at least one well pump, at least one well and a control panel with a timing trigger for activating said at least on well pump and deactivating said one well pump for a first predetermined run cycle and a first predetermined rest cycle, the improvement, which comprises:

a controller for adjusting at least one of said first predetermined run cycle and said predetermined rest cycle, said controller including:

(a) automatic shut off means to shut down said at lease one well pump when said well has a water level that falls below said pump during a run cycle;

(b) detecting means for detecting shut down of said at least one well pump when it is in a run cycle;

(c) downward adjustment means for decreasing said first run cycle or increasing said first rest cycle, or both, by a predetermined increment, in response to a detection of said shut down of said at least one well pump; and, (d) a computer device with sufficient hardware and software affiliated therewith so as to:

(i) read and store liquid levels of said at least one collecting tank at specified times during run cycles;

(ii) calculate rates of rise in said at least one collecting tank during run cycles by calculating differences in said liquid levels for specified periods of times;

(iii) associate said rates of rise with a chronological designation and store said rates of rise with their associates chronological designation;

(iv) compare a new calculated rate of rise with an earlier stored rate of rise to determine if a change had occurred in excess of a specified incremental difference; and, (v) if a change has not occurred in excess of a specified increment difference, maintain status quo, and if a change has occurred with excess of a specified incremental difference, if an increase has occurred, increase said run cycle or decrease said rest cycle, or both, by a predetermined amount, and if a change has occurred in excess of a specified incremental difference, if a decrease has occurred, decrease said run cycle or increase said rest cycle, or both, by a predetermined amount.

15. The system of claim 14 wherein said computer device operates on the basis of utilizing said first run cycle and said first rest cycle to obtain said earlier stored rate of rise as a benchmark for all comparisons of step (iv).

16. In a well production management and storage system having at least one collecting tank, at least one well pump, at least one well and a control panel with a timing trigger for activating said at least on well pump and deactivating said one well pump for a first predetermined run cycle and a first predetermined rest cycle, the improvement, which comprises:

a controller for adjusting at least one of said first predetermined run cycle and said predetermined rest cycle, said controller including:

(a) automatic shut off means to shut down said at lease one well pump when said well has a water level that falls below said pump during a run cycle;

(b) detecting means for detecting shut down of said at least one well pump when it is in a run cycle;

(c) downward adjustment means for decreasing said first run cycle or increasing said first rest cycle, or both, by a predetermined increment, in response to a detection of said shut down of said at least one well pump; and, (d) a computer device with sufficient hardware and software affiliated therewith so as to:

(i) read and store well water level in said at least one well at specified times during run cycles;

(ii) associate each said read water level with a chronological designation and store said the pressures with their associated chronological designation;

(iii) compare a new read water level with an earlier stored water level to determine if a change had occurred in excess of a specified incremental difference; and, (iv) if a change has not occurred in excess of a specified increment difference, maintain status quo, and if a change has occurred in excess of a specified incremental difference, and if the change is an increase, increase said run cycle or decrease said rest cycle, or both, by a predetermined amount, and if a change has occurred in excess of a specified incremental difference, and if the change is a decrease, decrease said run cycle or increase said rest cycle, or both, by a predetermined amount.

17. The system of claim 16 wherein said computer device operates on the basis of utilizing said first run cycle and said first rest cycle to obtain said earlier stored well water level as a benchmark for all comparisons of step (iii).

* * * * *